US011305441B2

(12) United States Patent
Zantout et al.

(10) Patent No.: US 11,305,441 B2
(45) Date of Patent: Apr. 19, 2022

(54) TOOL FOR REMOVING A HEAD ASSEMBLY OR A KNOT OF A TIE SECURED AROUND AN OBJECT

(71) Applicant: DANIELS MANUFACTURING CORPORATION, Orlando, FL (US)

(72) Inventors: Alan Emad Zantout, Sycamore, IL (US); Trevor D. Fildes, DeKalb, IL (US)

(73) Assignee: DANIELS MANUFACTURING CORPORATION, Orlando, FL (US)

( * ) Notice: Subject to any disclaimer, the term of this patent is extended or adjusted under 35 U.S.C. 154(b) by 14 days.

(21) Appl. No.: 16/910,398

(22) Filed: Jun. 24, 2020

(65) Prior Publication Data

US 2020/0398448 A1 Dec. 24, 2020

Related U.S. Application Data

(60) Provisional application No. 62/865,410, filed on Jun. 24, 2019.

(51) Int. Cl.

| | |
|---|---|
| ***B26B 3/00*** | (2006.01) |
| ***B26B 29/02*** | (2006.01) |
| *B25G 1/10* | (2006.01) |
| *B26B 5/00* | (2006.01) |

(52) U.S. Cl.

CPC ..... *B26B 3/00* (2013.01); *B26B 29/02* (2013.01); *B25G 1/102* (2013.01); *B26B 5/006* (2013.01)

(58) Field of Classification Search

CPC ..... B65B 69/0025
USPC ..... 30/278, 280
See application file for complete search history.

(56) References Cited

U.S. PATENT DOCUMENTS

| | | | | |
|---|---|---|---|---|
| 1,770,336 | A * | 7/1930 | Gruber | B43L 23/06 30/456 |
| 2,881,520 | A * | 4/1959 | Mito | B43M 7/002 30/280 |
| 3,461,555 | A | 8/1969 | Bliznak | |
| 3,613,241 | A * | 10/1971 | Allen | B26B 27/00 30/294 |
| 3,791,031 | A * | 2/1974 | Brothers | B26B 27/00 30/124 |

(Continued)

FOREIGN PATENT DOCUMENTS

| | | | |
|---|---|---|---|
| CA | 2 851 292 | * | 4/2017 |
| EP | 2 873 498 | * | 5/2015 |

OTHER PUBLICATIONS

ISA/US, Int. Search Report and Written Opinion issued on PCT application No. US20/39298, dated Sep. 21, 2020, 12 pages.

*Primary Examiner* — Hwei-Siu C Payer
(74) *Attorney, Agent, or Firm* — Matthew G. McKinney, Esq.; Allen, Dyer, Doppelt + Gilchrist, P.A.

(57) ABSTRACT

A tool for removing a head or knot of a cable bundling device includes a housing, an opening, and a cutting element disposed within the opening. The housing defines the opening and a funneling element is position within the opening to direct the object to be cut towards an exposed cutting edge of the cutting element. The opening and funneling element are sized and arranged to accommodate the head or knot of the cable device while preventing any undesirable articles from being exposed to the cutting edge. The funneling element includes a wedge shape to prove improved access between the cable tie and the cutting edge.

19 Claims, 9 Drawing Sheets

(56) References Cited

U.S. PATENT DOCUMENTS

| | | | | |
|---|---|---|---|---|
| 4,459,717 | A * | 7/1984 | Halstead | B25B 25/00 30/250 |
| 5,282,316 | A * | 2/1994 | Anderson | B26B 5/006 30/125 |
| 8,622,440 | B2 | 1/2014 | Crichton et al. | |
| 8,701,295 | B2 * | 4/2014 | Clearman | B43M 7/007 30/294 |
| 9,186,804 | B2 * | 11/2015 | Wright | B26D 7/01 |
| 9,682,806 | B2 | 6/2017 | Zantout et al. | |
| 9,701,030 | B1 * | 7/2017 | Hodges | B26B 29/063 |
| 2018/0042300 | A1 | 2/2018 | Fritz | |
| 2018/0319029 | A1 | 11/2018 | Marinovich et al. | |
| 2020/0398448 | A1 * | 12/2020 | Zantout | B26B 3/00 |

* cited by examiner

TOOL FOR REMOVING A HEAD ASSEMBLY OR A KNOT OF A TIE SECURED AROUND AN OBJECT

CROSS REFERENCE TO RELATED APPLICATION

This application is a non-provisional application claiming priority from U.S. Provisional Application Ser. No. 62/865,410 filed Jun. 24, 2019, and incorporated herein by reference in its entirety.

FIELD OF THE DISCLOSURE

The present disclosure relates generally to cutting tools and more particularly to a tool for removing a head assembly or a knot of a tie secured around an object.

BACKGROUND OF RELATED ART

Various methods and devices may be used to tie or bundle objects, such as cables together. By way of example, U.S. Pat. No. 9,682,806 describes a tie used to hold together a plurality of objects. With reference to prior art FIG. 4, a head assembly 12 of the tie 10, which is attached to a first end of a tape 14, is moved to a position at or near a plurality of objects, such as a group of wires W that are arranged to form a bundle B, while a second end 28 of the tape 14 is looped around the plurality of objects and passed through the head assembly 12. The second end 28 of the tape 14 is thereafter pulled through the head assembly 12 to secure the tie 10 tightly around the plurality of objects.

By way of further example, U.S. Pat. No. 8,622,440 describes a device for forming a knot in a tie to secure the tie tightly around one or more objects.

To remove a head assembly (or a formed knot) from a tie after the tie is secured around one or more objects, such as a utility knife or razor blade is commonly utilized. However, it is seen that using a utility knife or razor blade to remove the head assembly (or the formed knot) can result in the undesirable cutting of the object(s) that are being secured by the tie and/or the user of the utility knife.

One example cutting device is described in U.S. Pat. No. 5,282,316A. The example device consists of a hand held razor-containing cutting device formed from two separable halves that are connected together during use. The tool includes a hook-shaped cutting edge at one end to direct the object to be cut towards a cutting edge while the tool is pulled towards the other end of the tool, which is usually towards the user.

While the referenced devices may be sufficient for their intended purposes, there remains an identifiable need to provide an improved cutting device for certain applications.

SUMMARY

Described herein is tool that is usable to safely remove the head assembly or a knot of a tie that has been secured around one or more objects.

A better appreciation of the objects, advantages, features, properties, and relationships of the subject tool will be obtained from the following detailed description and accompanying drawings which set forth illustrative examples which are indicative of the various ways in which the principles of the described tool may be employed.

DETAILED DESCRIPTION

The following disclosure of example methods and apparatus is not intended to limit the scope of the detailed description to the precise form or forms detailed herein. Instead the following disclosure is intended to be illustrative so that others may follow its teachings.

Figure 1:
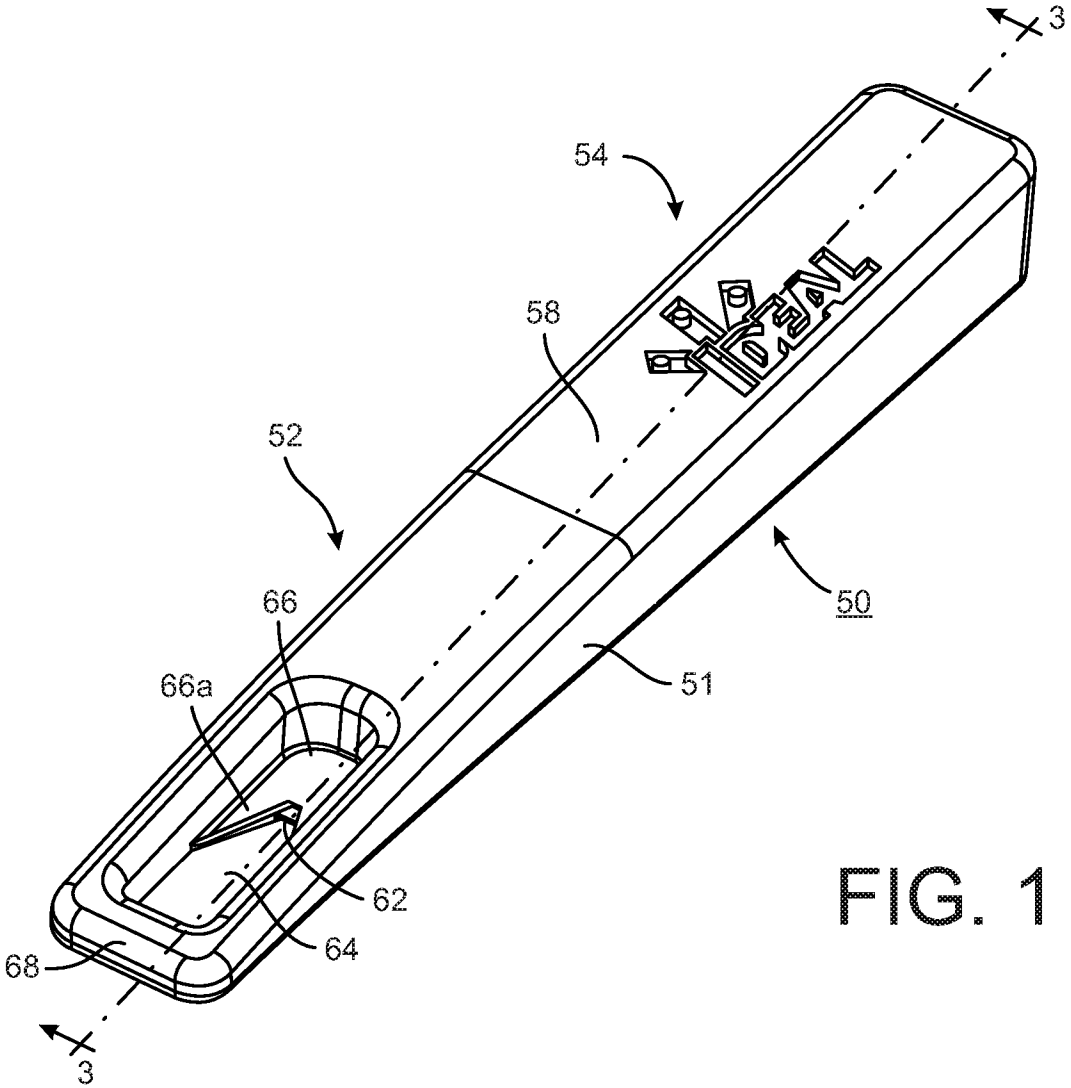
FIG. 1 is a perspective view showing a top side, front side, and left side on an example tool for removing a head assembly (or a knot) from a tie.
Figure 2:
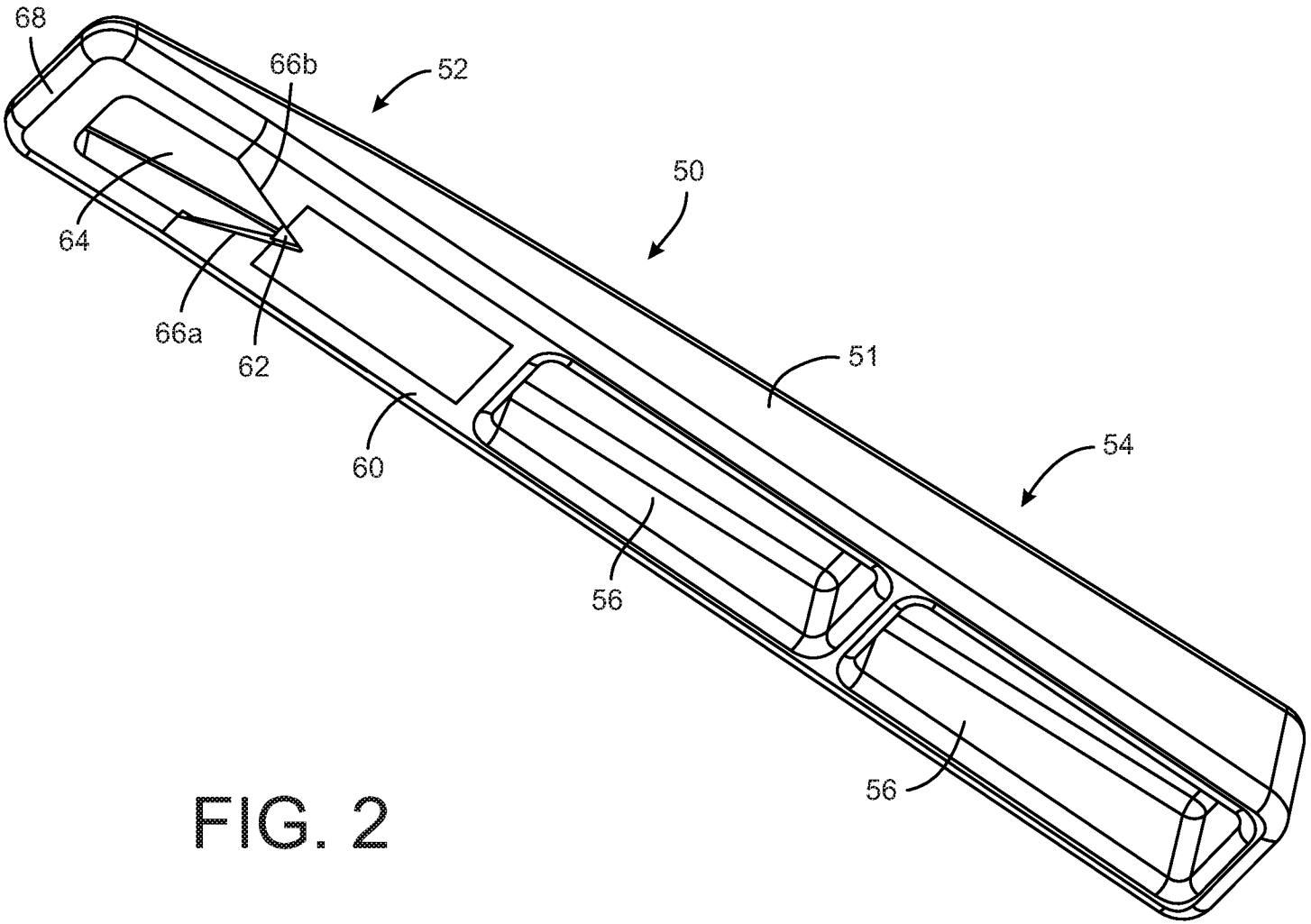
FIG. 2 is a perspective view showing a bottom side, front side, and left side of the tool shown in FIG. 1.
Figure 3:
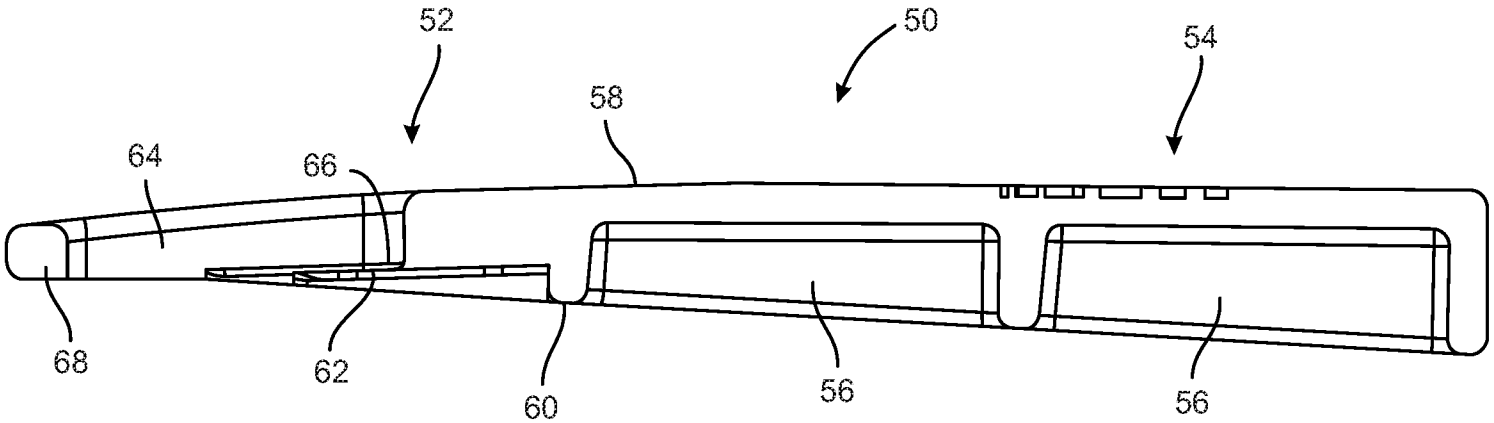
FIG. 3 is a cross-sectional view of the tool shown in FIG. 1 taken along line 3-3.
Figure 4:
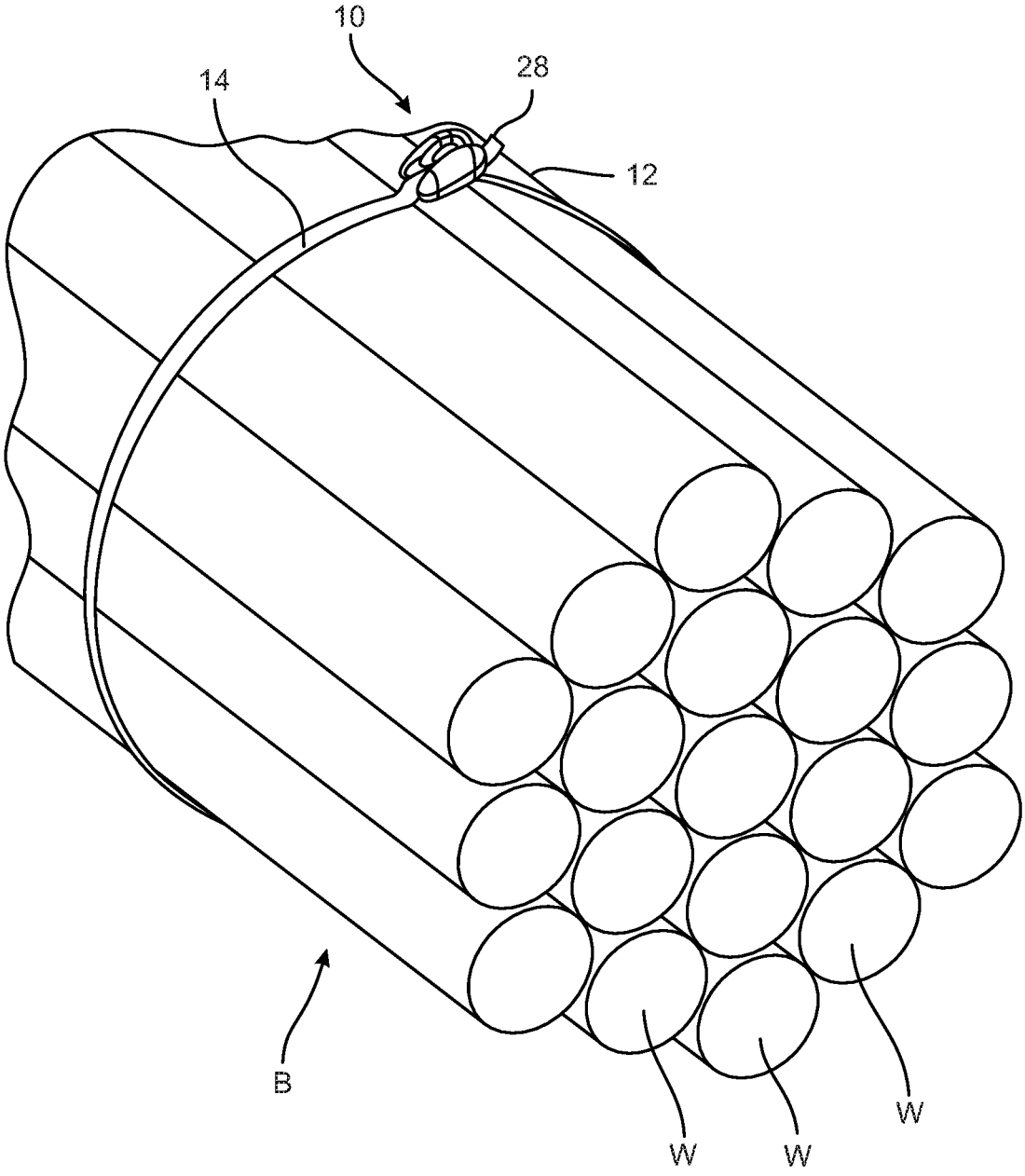
FIG. 4 PRIOR ART
FIG. 4 is a perspective view of an example prior art tie installed on an example bundle of wires.
Figure 5A:
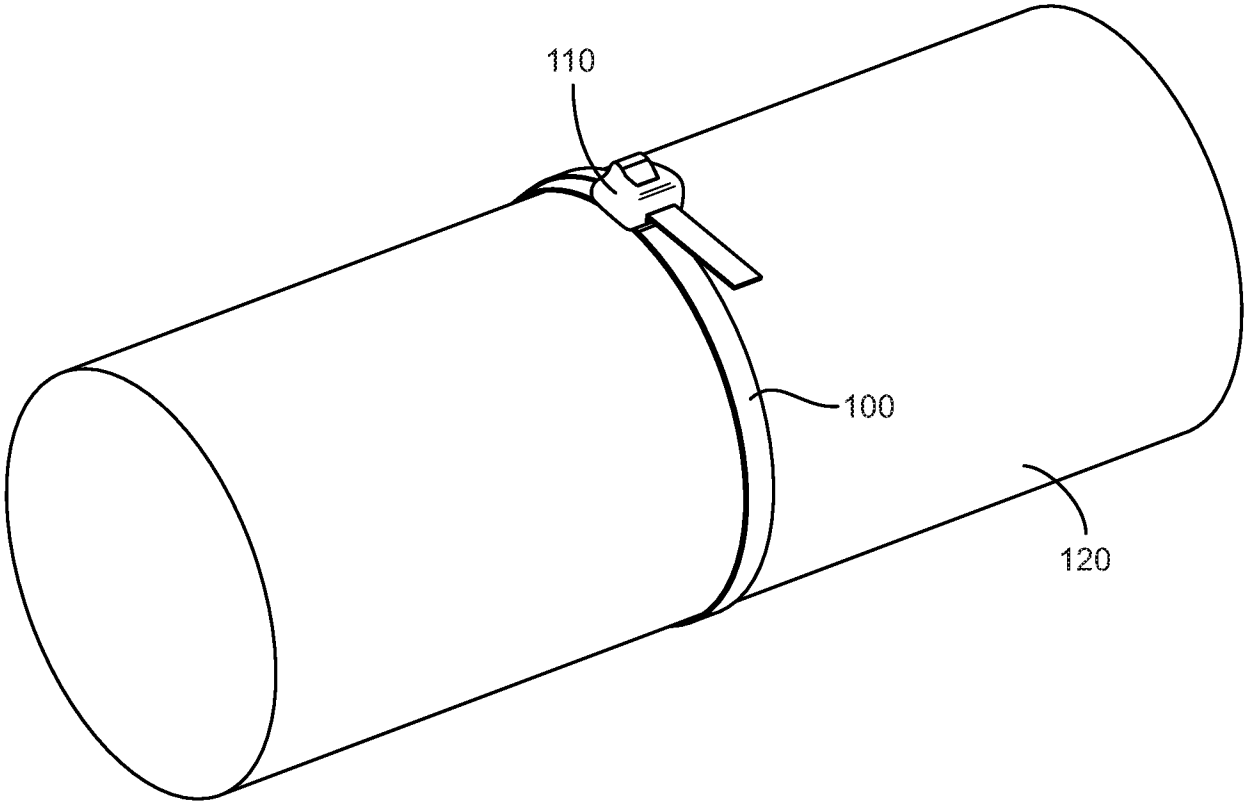
FIG. 5A is a perspective view of an example object wrapped in an example tie.
Figure 5B:
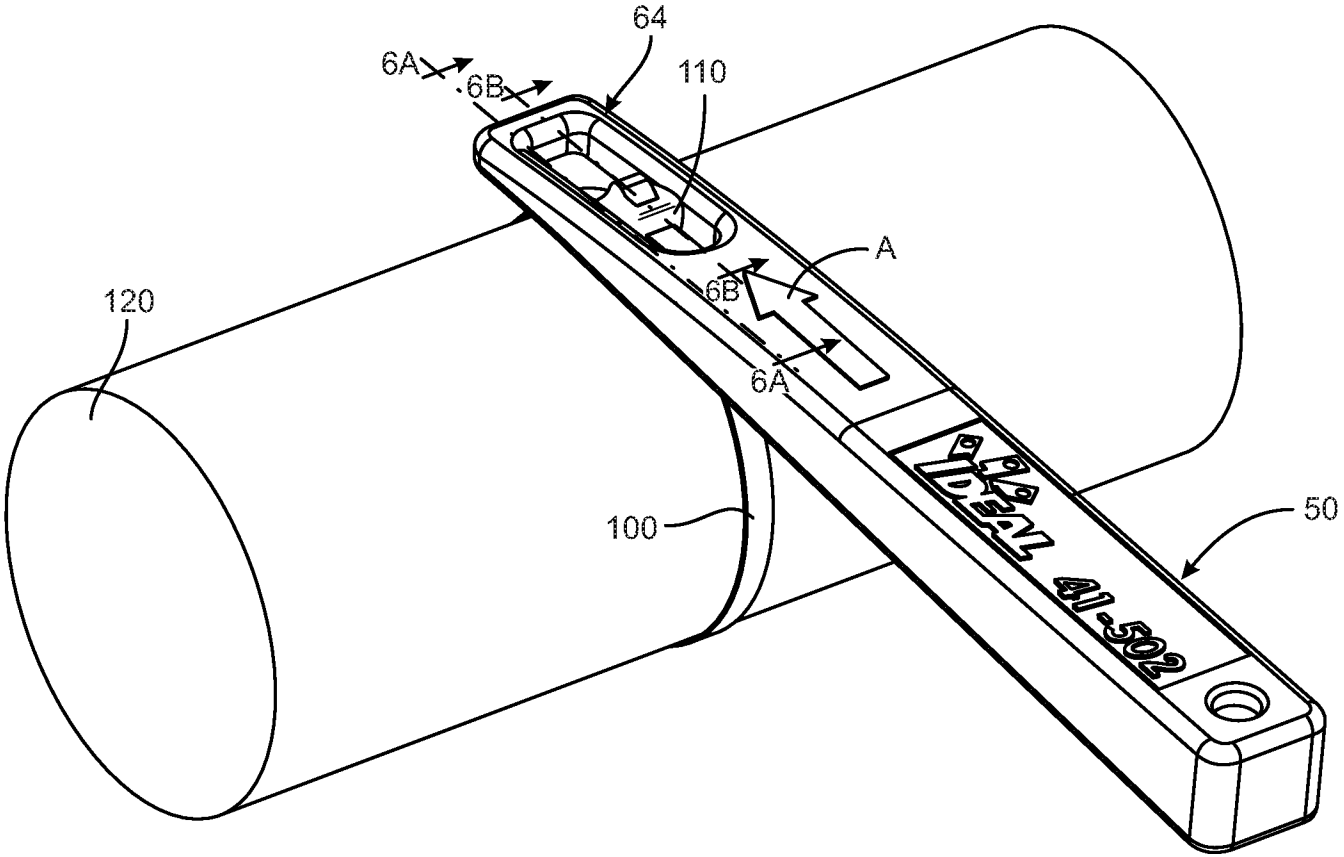
FIG. 5B is another perspective view of the example tie of FIG. 5A as it is being removed by the example tool.
Figure 6A:
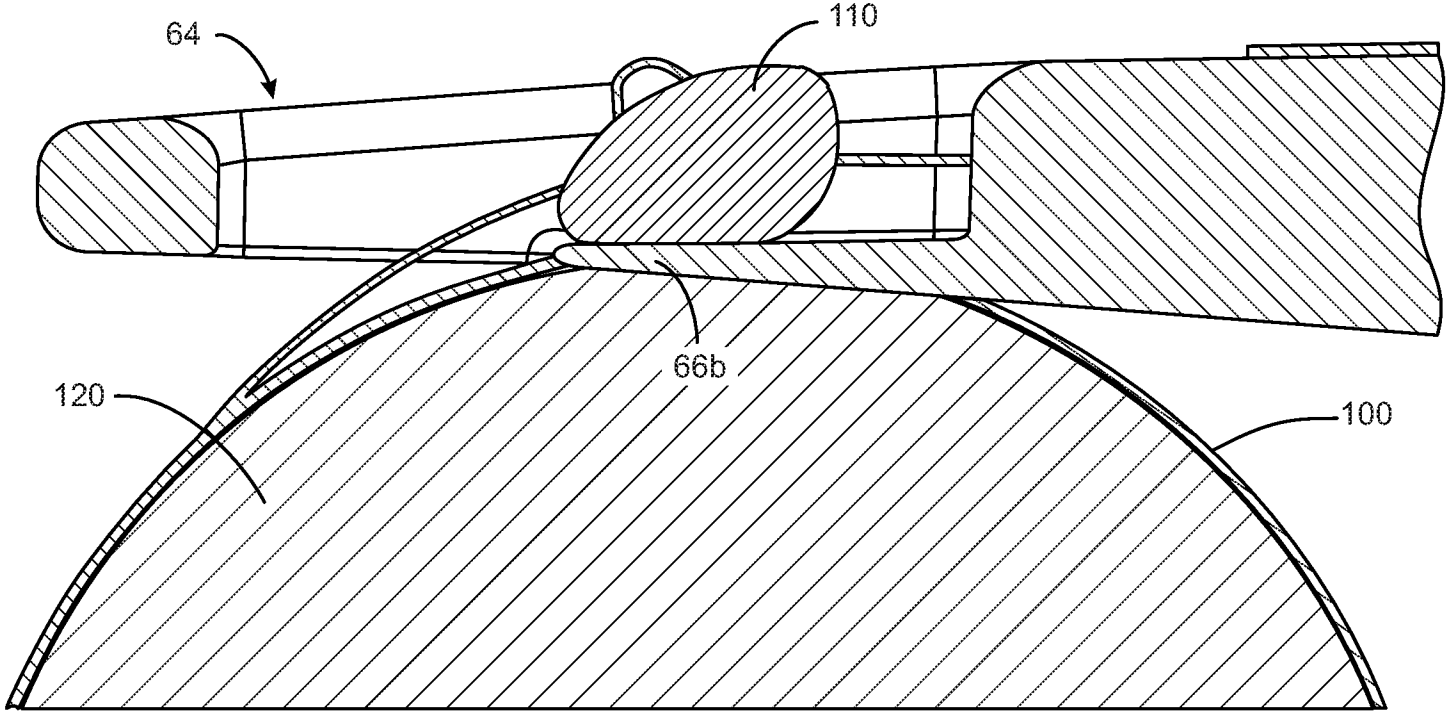
FIG. 6A is a cross-sectional view of the tool shown in FIG. 5B taken along line 6A-6A.
Figure 6B:
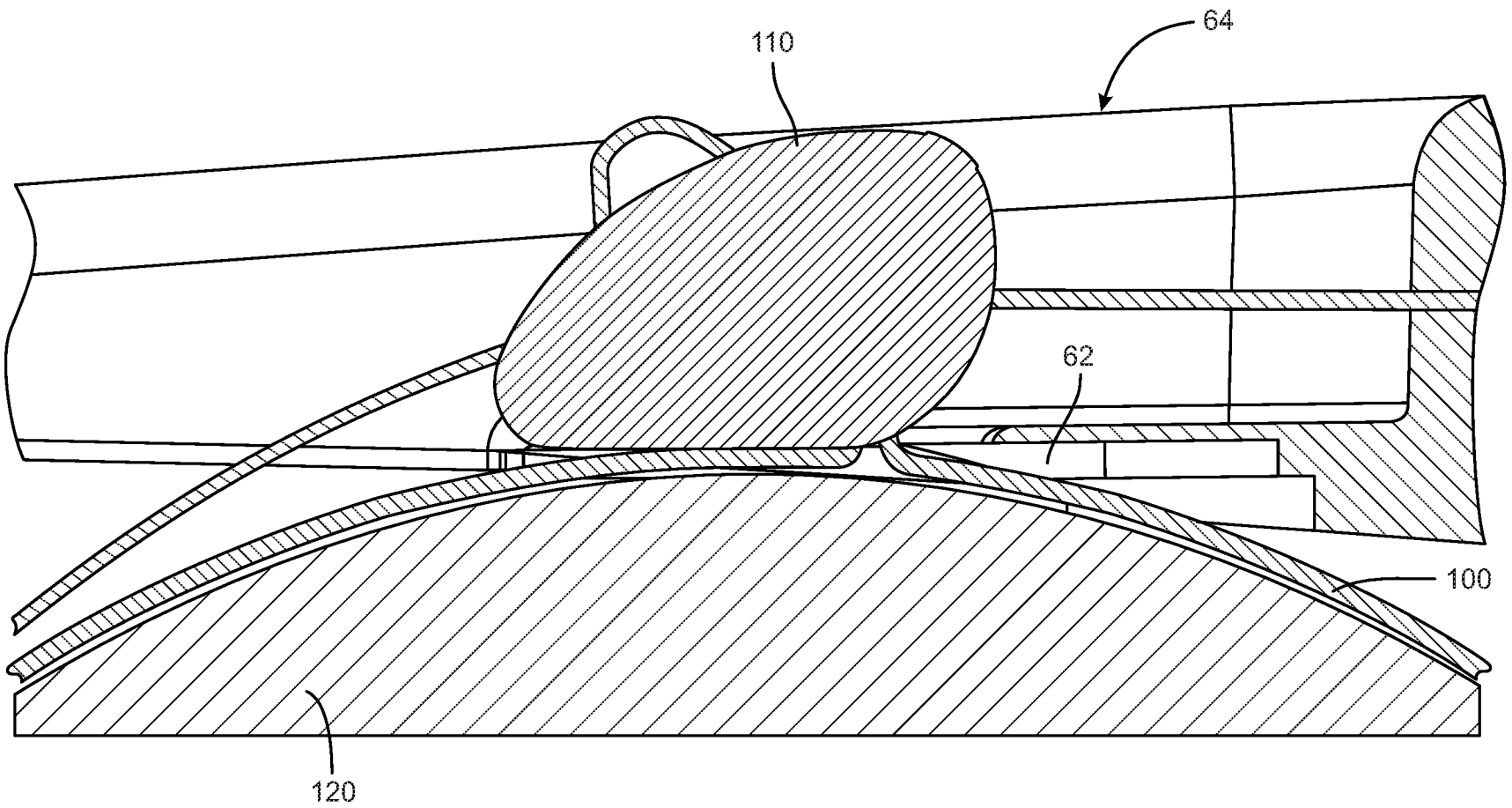
FIG. 6B is a cross-sectional view of the tool shown in FIG. 5B taken along line 6B-6B.

Referring now to FIG. 1, an example tool for removing a head assembly (or a knot) of a cable bundling device, such as a cable tie, zip tie, cable, or other suitable device, after the tie is secured around one or more objects is disclosed. As shown in FIGS. 1-3, the example tool 50 comprises a housing 51 that is formed from a non-conductive material, such as a plastic material (or other material as desired) and generally includes a working end 52 and a grasping end 54 that is sized and arranged to be held in a hand of a user. The housing 51 further comprises an upper surface 58 and a lower surface 60. While not required, the grasping end 54 may include one or more indentations 56 in the tool 50, such as the example indentations illustrated in the lower surface 60, for receiving the fingers of the user as the user holds the tool 50, reducing weight, modifying flexibility of the tool 50, providing storage options, etc. In addition, while the indentations are illustrated as not passing through the housing 51 in some example drawings, it will be appreciated by one of ordinary skill in the art that the indentations may pass partially into or fully through the housing 51 as desired, such as illustrated in at least FIG. 5B.

As further shown in FIG. 3, the tool 50 is generally wedge shaped in profile and the upper surface 58 and the lower surface 60 of the tool 50 may be slightly curved, in whole or in part, as desired to render the device more ergonomic. Carried within the working end 52 of the tool is a cutting element 62, such as a razor blade or the like, which is provided for the purpose of removing the head assembly (or the knot) from a tie after the tie is secured around one or more objects. In this example, the cutting element 62 is molded into the tool 50, but in other instances, it will be appreciated that the cutting element 62 may be permanently or removably mounted to the tool 50 as desired.

More particularly, the working end 52 of the tool 50 includes an opening 64 that is sized and arranged to receive the head assembly (or the knot) of the tie (while being sized and arranged to inhibit the insertion therein of an unwanted element, such as a finger or the like including all or a portion of the wire bundle being restrained). As further illustrated, the opening 64 is provided with a funnel like shape (which is created via use of a pair of opposed, angled surfaces 66*a* and 66*b* of a lifting element 66 that is disposed in the opening 64 and from which the cutting edge of the cutting element 62 is exposed) for guiding a portion of a tie to be cut towards the exposed cutting edge of the cutting element 62. In this regard, the cutting element 62 may be molded into the tool 50 (or the tool 50 may be provided with a mechanism to allow the cutting element to be releasably secured within the tool 50 as desired) in such a manner that only a small portion of the cutting element 62 is exposed to provide the cutting edge.

In a preferred example, the angled surfaces of 66*a* and 66*b* provide an adequate amount of exposed cutting edge to allow for cutting and removal of the head/knot while preventing wire having a wire diameter greater than a predetermined wire diameter from entering into contact with the cutting edge which, among other things, reduces the risk of damaging the wire bundle. Furthermore, it is desired that the cutting edge of the cutting element 62 be slightly raised relative to the lower surface 60 of the tool 50, for example by providing a blade chamfer surface that faces upwards to provide a gap between the bottom handle surface 60 and the cutting element 62, to inhibit access to the exposed cutting edge from the underside of the tool 50. For further inhibiting access to the exposed cutting edge of the cutting element 62, a forward most portion of the working end 52 of the tool 50 is further provided with a guard element 68 (where the guard element 68 defines a part of the opening 64).

As will be appreciated from the foregoing, the guard element 68 functions to limit access to the cutting edge of the cutting element 62 from the front of the tool 50, the arrangement of the walls of the tool 50 that form the opening 64 and the positioning of the cutting edge of the cutting element 62 relative to the opening 64 function to limit access to the cutting edge from the top or bottom of the tool 50, and the funnel shape provided to the opening 64 via use of the elements 66*a* and 66*b* of the lifting surface 66 functions to limit the size of an element which may be directed towards the cutting edge of the cutting element and, as such, the tool 50 is provided with elemental features that assist in inhibiting the cutting of unintended items by the cutting element 62.

In operation, as illustrated in FIGS. 5A, 5B, 6A, and 6B, it is contemplated that the tool 50 will be positioned over a tie 100 to be cut with the head assembly 110 (or the knot) of the tie 100 positioned within the opening 64 of the tool 50. The tool 50 will then be moved relative to the head assembly 110 (or the knot), such as in the direction of the arrow A, to cause a portion of the tie 100 that is adjacent to the head assembly 110 (or the knot) to be directed towards the cutting edge of the cutting element 62 (via use of the funnel shape provided to the opening 64) while the surfaces 66*a* and 66*b* of the lifting element 66 of the tool 50 will engage with an underside of the head assembly (or the knot), i.e., the lifting surfaces 66*a* and 66*b* will be slid between the head assembly 100 (or the knot) and an object 120 that is being secured by the tie (see FIG. 6A).

The lifting element 66, which is provided with a wedge like profile, will function to separate the head assembly 110 (or the knot) from the object 120 that is being secured by the tie 100 during this sliding operation to provide clean access by the cutting edge of the cutting element 62 to the portion of the tie that is to be cut. The sliding operation is then continued such that the cutting edge of the cutting element 62 of the tool 50 is driven through the portion of the tie 100 to thereby cause the cutting edge of the cutting element 62 to remove the head assembly (or the knot) from the tie thereby releasing the tie from the object (see FIG. 6B).

As previously noted, the angled surface 66*a* and 66*b* of the example tool 50 converge for guiding a portion of the tie to be cut towards the cutting edge of the cutting element 62. The two angled surfaces 66*a* and 66*b* converge at such a distance to prevent any object, such as a wire W or a user's finger, above a certain width or diameter from moving towards the cutting element 62 sufficiently far enough to contact the cutting element 62. In other words, the spacing between the edges 66*a* and 66*b* prevents any object that is too large from being contacted and cut by the cutting element.

Figure 7A:
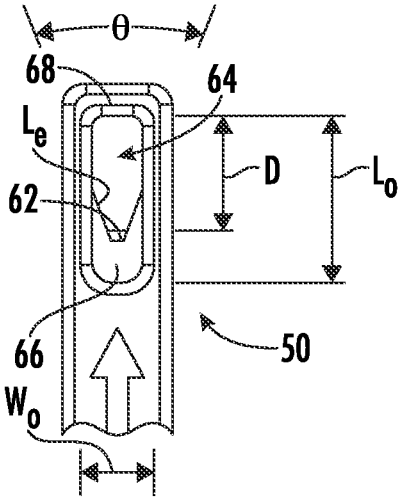
FIG. 7A is an enlarged, partial, top plan view of the tool shown in FIG. 1 showing example dimensions for the tool.
Figure 7B:
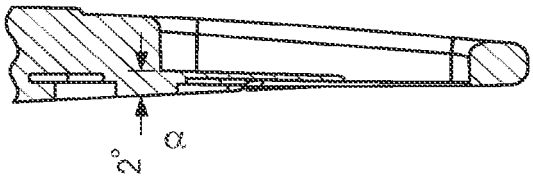
FIG. 7B is an enlarged, partial, side elevational view of the tool shown in FIG. 1 showing example dimensions for the tool.
Figure 7C:
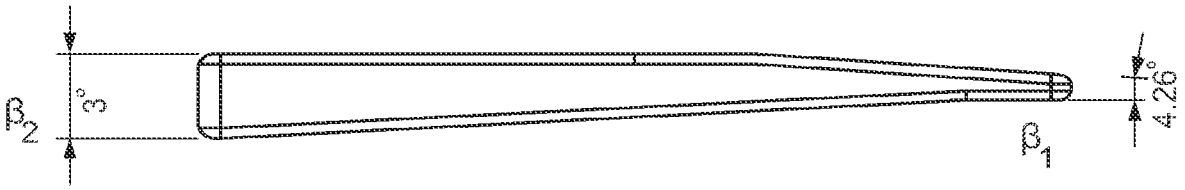
FIG. 7C is side elevational view of the tool shown in FIG. 1, showing further example dimensions for the tool.

More precisely, in the example illustrated in FIGS. 7A, 7B, and 7C, the tool 50 has various dimensions provided which are suitable for operation as disclosed herein. In the provided example, the opening 64 has a length $L_o$ of approximately 0.85 inches and a width $W_o$ of approximately 0.25 inches. In this configuration, the opening 64 is well suited to receive the head assembly (or the knot) of the tie, while being sized and arranged to inhibit the insertion therein of an unwanted element, such as a finger or the like including all or a portion of the wire bundle being restrained. In addition, the side edges of the example angled surfaces 66*a* and 66*b* converge at an angle θ of approximately 45°. In combination, with the angle θ, the cutting edge of the cutting element is offset a distance D of approximately 0.5-0.6 inches from the guard element 68, thereby leaving an exposure length Le of the cutting edge 62 (i.e., the exposed length of the cutting edge) of approximately 0.066 inches, which is sufficient to cut the tie 100 under example operating conditions. With the current dimensions, the tool 50 inhibits wire having an American wire gauge (AWG) of less than 26 from contacting the cutting edge 62 and thereby providing further protection against inadvertent damage to larger diameter wires.

Referring to FIGS. 7B and 7C, as noted above, the lifting element 66 is provided with a wedge like profile. In the illustrated example, the lifting element extends an angle α of approximately 2° from the bottom surface of the tool 50. This angle α functions to separate the head assembly 110 from the object 120 secured by the tie 100. In addition, as best viewed in FIG. 7C, the example tool 50 is also generally wedge shaped along its entire length from the front of the tool to the rear of the tool. Accordingly, the illustrated tool 50 includes a first angle $\beta_1$ of approximately 4.25° between the top surface of the tool 50 and the bottom surface of the tool 50 extending from the front edge of the tool 50 to approximately the front, leading edge of the elements 66, and a second angle $\beta_2$ of approximately 3° between the top surface of the tool 50 and the bottom surface of the tool 50, extending from the leading edge of the elements 66 and the back edge of the tool 50. These example tool dimensions assist in the ergonomic properties of the tool 50 (e.g., ease and comfort of grip) as well as optimizing the angles necessary for use in separating the head assembly 110 from the object 120.

It will be appreciated by one of ordinary skill in the art that other suitable dimensions may be utilized as desired, depending upon the item to be removed and the requirements for the usage and that the current dimensions provided for the example illustrated are merely illustrative of the teachings of the present invention.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A tool for removing a cable bundling device comprising:

a housing having a working end and a grasping end, the housing further comprising an upper surface and a lower surface;

an opening defined by the housing in the working end, wherein the opening is completely surrounded by the housing;

a cutting element carried within the working end of the tool; and a funneling member disposed in the opening and converging proximate to the cutting element to expose a portion of the cutting element to the opening and forming a cutting edge.

2. The tool of claim 1, wherein the opening is sized and arranged to receive a head assembly of the cable bundling device.

3. The tool of claim 1, wherein the funneling member is a pair of opposing, angled surfaces.

4. The tool of claim 3, wherein each of the pair of opposing, angled surfaces comprises a top surface and a bottom surface and the top surface and the bottom surface from a leading edge of the angled surfaces towards a trailing edge of the angled surfaces proximate to the cutting edge to form a general wedge shape.

5. The tool of claim 4, wherein the top surface and the bottom surface of the angled surfaces diverge at an angle of approximately 2°.

6. The tool of claim 3, wherein each of the opposing angled surfaces comprises side edges, and the side edges converge at an angle of approximately 45°.

7. The tool of claim 1, wherein the housing comprises a non-conductive material.

8. The tool of claim 1, wherein the cutting element is molded within the tool.

9. The tool of claim 1, wherein the cutting element is removably mounted to the housing.

10. The tool of claim 1, wherein a portion of the housing surrounding the opening proximate to the working end forms a guard element.

11. The tool of claim 10, wherein the funneling member is spaced apart from the guard element and the cutting element is located opposite the guard element.

12. The tool of claim 11, wherein the funneling member is located in the range of 0.5 inches to 0.6 inches from the guard element.

13. The tool of claim 1, wherein the cutting edge is approximately 0.066 inches wide.

14. The tool of claim 1, wherein the opening has a length of approximately 0.85 inches and a width of approximately 0.25 inches.

15. The tool of claim 1, wherein the upper surface and the lower surface of the housing diverge from the working end towards the grasping end to form a generally wedge shape.

16. A cutting tool comprising:

a housing having a working end and a grasping end, the housing further comprising an upper surface and a lower surface;

an opening defined by the housing and located in the working end, the opening being completely surrounded by the housing;

a cutting element mounted within the working end of the tool; and a funneling member disposed in the opening and converging proximate to the cutting element to expose a portion of the cutting element to the opening, forming a cutting edge.

17. The cutting tool of claim 16, wherein the funneling member is a pair of opposing, angled surfaces.

18. The tool of claim 17, wherein each of the pair of opposing, angled surfaces comprises a top surface and a bottom surface and the top surface and the bottom surface from a leading edge of the angled surfaces towards a trailing edge of the angled surfaces proximate to the cutting edge to form a general wedge shape.

19. The cutting tool of claim 16, wherein the upper surface and the lower surface of the housing diverge from the working end towards the grasping end to form a generally wedge shape.

* * * * *